United States Patent [19]

Nagamoto et al.

[11] Patent Number: 4,621,246

[45] Date of Patent: Nov. 4, 1986

[54] POLARIZED ELECTROMAGNET RELAY

[75] Inventors: Mitsuki Nagamoto, Tsu; Atsushi Nakahata, Mie; Takuo Kubota, Tsu, all of Japan

[73] Assignee: Matsushita Electric Works, Ltd., Japan

[21] Appl. No.: 759,103

[22] Filed: Jul. 25, 1985

[30] Foreign Application Priority Data

Jul. 25, 1984 [JP] Japan ..... 59-113906[U]
Jul. 25, 1984 [JP] Japan ..... 59-113907[U]
Dec. 12, 1984 [JP] Japan ..... 59-275925

[51] Int. Cl.[4] ..... H01H 51/22
[52] U.S. Cl. ..... 335/78; 335/79
[58] Field of Search ..... 335/78, 79, 80, 81, 335/229, 230, 234

[56] References Cited

U.S. PATENT DOCUMENTS 3,634,793 1/1972 Sauer .
4,538,126 8/1985 Bando ..... 335/78
4,563,663 1/1986 Niekawa et al. ..... 335/79 X

*Primary Examiner*—George Harris
*Attorney, Agent, or Firm*—Stevens, Davis, Miller & Mosher

[57] ABSTRACT

A polarized electromagnet relay with reduced width and height is disclosed to have on a base plate an electromagnet block, an armature block with a permanent magnet and at least one contact assembly. The armature block is cooperative with the electromagnet block and is driven in response to the energization thereof to reciprocate between two operating positions so as to actuate the contact assembly for contact switching. The electromagnet block includes a generally E-shaped yoke with a pair of opposed side legs and a center leg defining a core around which the excitation coil is wound. The contact assembly is mounted on the lateral side of the base plate to be received between the adjacent side leg and the base plate so as not to add an extra dimension to the width of the relay. The yoke is configured to have the center leg or core displaced from the plane of the side legs toward the base plate in such a manner as to produce a more space above the core as well as between the core and each of the side legs for receiving the coil. By better utilization of such space the coil can be wound a greater number of turns without substantially projecting above that plane, so as not to add an extra dimension to the height of the relay, thus enabling the relay design of reducing both the width and the height while allowing the use of the coil with a greater number of turns.

6 Claims, 10 Drawing Figures

POLARIZED ELECTROMAGNET RELAY

BACKGROUND OF THE INVENTION

1. Field to the Invention

The present invention is directed to a polarized electromagnet relay, and more particularly to a flat and compact type of polarized electromagnet relay with at least one contact assembly which is arranged between the planes of the yoke of an electromagnet block and a base plate of the relay to be actuated for contact switching by an armature block driven to reciprocate between two positions in response to the excitation of the electromagnet block.

2. Description of the Prior Art

The above relay construction of arranging the contact assembly between the planes of the yoke of an electromagnet block and a base plate of the relay is known to be effective for attaining a compact relay structure with a reduced width as shown, for example, in U.S. Pat. No. 3,634,793. This patent discloses a pair of contact assemblies received between the yoke and the base plate. An excitation coil has its axis aligned in the plane of the opposed side yoke legs and has its upper portion projecting above that plane, which portion adds an extra height to the relay dimension and therefore is desired to be eliminated for the purpose of attaining a more compact relay construction with reduced height as well as width. The above adverse effect will be more serious when the coil is required to have a greater number of turns within a limited length. Another prior polarized relay is disclosed in U.S. Pat. No. 3,518,592 which is employable in providing the above relay construction. This patent utilizes an E-shaped yoke with a pair of opposed side legs and a center leg forming a core around which a coil is wound. However, with this yoke having the center leg or core arranged in the same plane of the side legs of the yoke, the coil wound around the core cannot avoid projecting beyond the plane of the side legs and certainly adds an extra height to the relay construction. In addition, this yoke configuration can afford less spacing between the center leg and the side legs, thus limiting the number of coil turns to a lesser extent. That is, the number of coil turns can be increased only by elongating the core, or increasing the length of the coil, which results in an increased length of the overall relay construction and is therefore should be eliminated for designing a more compact or miniaturized relay. Therefore, an optimal space utilization for the coil is most desirous in order to attain a more compact arrangement of this kind of the polarized relay without impairing electrical insulation between the parts of the relay.

SUMMARY OF THE INVENTION

The present invention has been achieved in view of the above and provides a unique and advantageous construction which enables an optimal space utilization for accommodating the coil within a limited space of the overall relay and allows the coil to have an increased number of turns while preserving the overall dimensions at a minimum.

The polarized relay in accordance with the present invention includes an electromagnet block, an armature block with a permanent magnet, at least one contact assembly, and a base plate mounting thereon the above blocks and the contact assembly. The electromagnet block comprises a generally E-shaped yoke with a pair of opposed side legs and a center leg which defines a core around which an excitation coil is wound. Said armature block cooperates with the electromagnet block and is driven to reciprocate upon energization of the coil between two operating positions for actuating the contact assembly to perform an electrical switching action. The distinguishing features of the present invention reside in that the core is displaced from the plane of the opposed side legs of the yoke toward the base plate and that said contact assembly is disposed on the side of the core so as to be located between the adjacent side leg of the yoke and the base plate within the width of the yoke.

With this arrangement, more space is available between the core and the side legs for the coil to be wound around the core than is obtained in the prior relay with the core lying in the same plane of the side legs such that a greater number of turns of coil can be incorporated in the electromagnet block by better utilization of that space and without requiring additional length for the core or the electromagnet block. This also makes it possible to accommodate the entire coil between the planes of the side legs of the yoke and the base plate. That is, the major portion of the coil can be accommodated between the above two planes with the minor portion thereof extending into the space between the opposed side legs of the yoke such that the coil will not project outwardly beyond the plane of the yoke, thus serving to maintain the overall height of the relay at a minimum.

Said contact assembly is disposed on the lateral side of the coil or the internally projecting portion of the coil so as to be located between the adjacent side leg and the base plate within the width of the yoke, thus maintaining the width of the relay at a minimum. In other words, the coil can be received in the relay construction by the optimal utilization of the space that is required between the above two planes for accommodating therein the contact assembly, whereby the parts of the relay can be packed in less space with maximum utilization of the relay cross section to enable the design of the relay with reduced height and width.

Accordingly, it is a primary object of the present invention to provide a polarized relay in which the coil is received in the overall relay construction by optimal space utilization so as to provide a more compact relay structure, yet assuring a greater number of turns of coil for increased sensitivity of response.

Included in the armature block are a pair of pole plates between the ends of which said permanent magnet is held to magnetize the pole plates to opposite polarity. The armature block is magnetically coupled with the electromagnet block such that the free end of the core extends between the opposed inner pole faces of the pole plates and that at least one of the pole plates has its outer pole face away from the core and being in magnetically connectable relation with the pole end of the adjacent side leg of the yoke. Thus, the magnetic flux from the permanent magnet of the armature block can pass through the core in proximity to the inner pole face of one of the pole plates and through the adjacent pole end of the yoke in proximity to the outer pole face of the other pole plate to thereby complete the magnetic circuit at either or both of the two positions of the armature block, whereby ensuring to stably hold or latch the armature block at either or both of its two positions. When both of the pole plates have the individual outer pole faces in magnetically connectable relation with the respective pole ends of the yoke, the polarized relay can be of bistable type, while it can be of monostable type when only one of the pole plates has its outer pole face in such relation with the corresponding pole end of the yoke.

The contact assembly comprises a movable spring extending in generally parallel relation with the adjacet side leg with its one end fixed to the base plate and carrying on the other end a movable contact which is cooperative with at least one fixed contact to define a switching contact portion. The contact assembly is mounted on the base plate with its switching contact portion located on one longitudinal end of the base. Said movable spring is in engageable relation with a corresponding actuator section formed on the armature block so that it is actuated by the armature block reciprocating between its two positions for contact switching.

In a preferred embodiment, the side leg of the yoke extending longitudinally of the base terminates at a point longitudinally inwardly of said switching contact portion in such a way as not to extend over said switching contact portion, leaving the switching contact portion to be opened upwardly of the yoke so as to be accessible from above. With this arrangement, the adjustment of contact pressure or the like characteristic, which may be sometimes required after assembling the parts on the base plate, can be readily performed without being jammed by the yoke mounted on the base plate.

It is therefore another object of the present invention to provide a polarized relay which permits an easy after-assemble adjustment of contact pressure or the like characteristics.

The present invention discloses in a further preferred embodiment that the yoke of the electromagnet block includes a connecting bar rigidly bridging the pole ends of the side legs for reinforcement of the yoke. Because of this reinforcement, the distance between the pole ends of the yoke can be kept constant during the assembly as well as the actual operation, maintaining an exact air gap between the opposed parts of the relay, thus facilitating the exact assembly of the relay as well as ensuring a constant attractive force to be applied to the armature block for a reliable armature or relay operation over a longer period of use, which is therefore a still further object of the present invention.

These and other advantageous features will become more apparent from the following description of the preferred embodiments of the present invention when taken in conjunction with the accompanying drawings.

DESCRIPTION OF THE PREFERRED EMBODIMENTS

Figure 1:
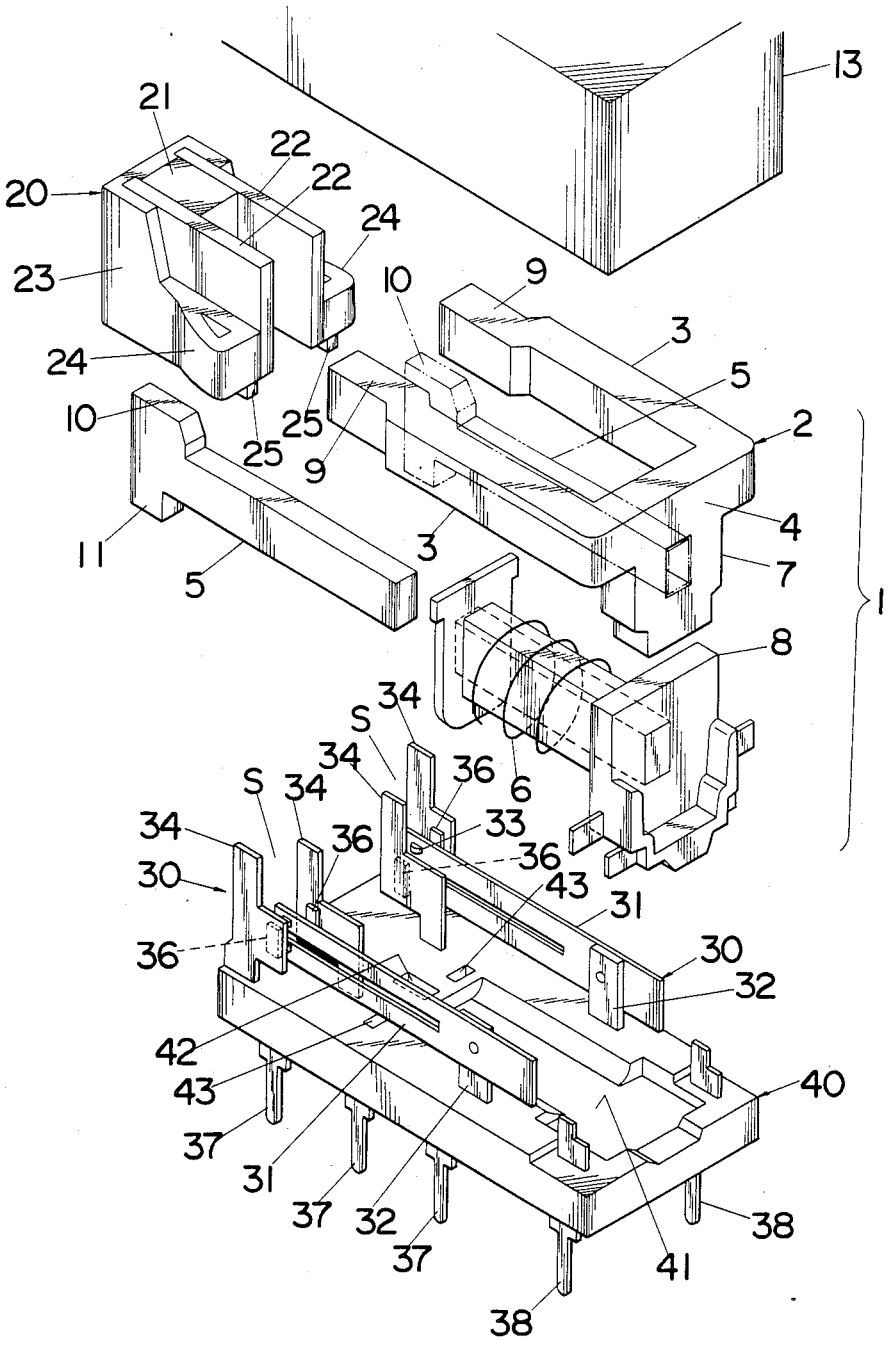
FIG. 1 is an exploded parts view, in perspective representation, of a polarized relay in accordance with a first embodiment of the present invention.
Figure 2:
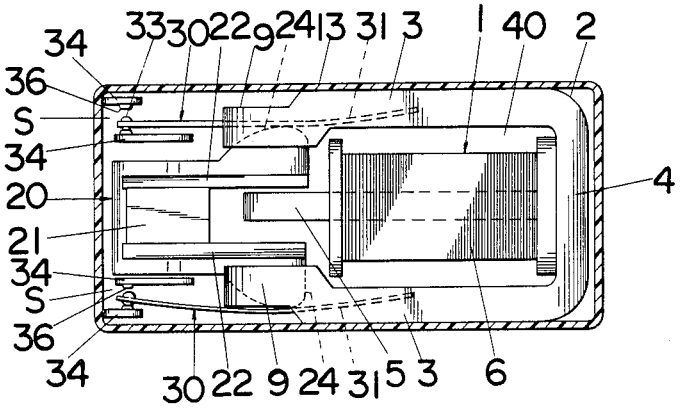
FIG. 2 is an top view of the above relay with a part of its cover being removed.
Figure 3:
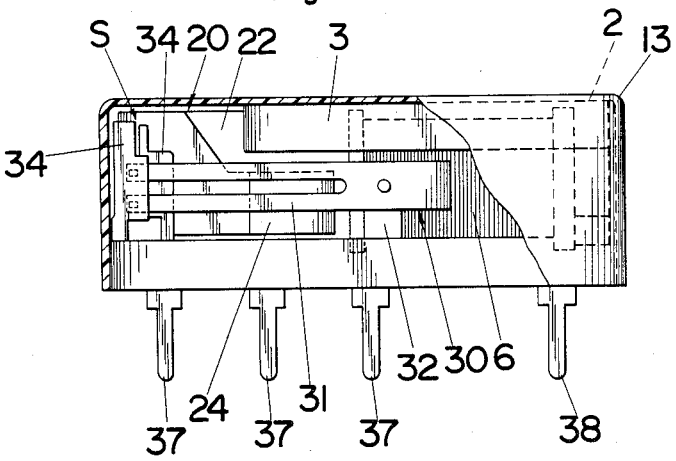
FIG. 3 is a front view of the above relay with a part of the cover being removed.
Figure 4:
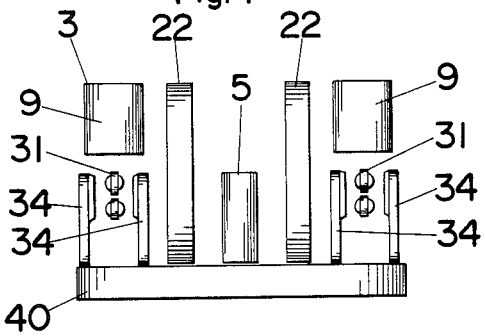
FIG. 4 is an explanatory view, in somewhat cross sectional representation, of the vertical arrangement of the principal parts of the above relay.

Referring firstly to FIGS. 1 to 4, there is shown a polarized magnetic relay in accordance with a first preferred embodiment of the present invention. The relay comprises an electromagnet block 1, an armature block 20 with a permanent magnet 21, a pair of contact assemblies 30, and a base plate 40 mounting thereon the above parts. The electromagnet block 1 includes a generally E-shaped yoke 2 with a pair of opposed side legs 3 connected by a web member 4 and a center leg or core 5 extending in the same direction from the center of the web member 4 for carrying therearound an excitation coil 6. The core 5 has its one end pressed into a downwardly projecting tab 7 of the web member 4 for integral connection therewith and extends in parallel relation with the side legs 3 but in a plane displaced downwardly from the plane of the side legs 3, as best shown in FIG. 4. The core 5 extends through a coil bobbin 8 around which said coil 6 is wound for supporting the same. The free ends of the side legs 3 are bent inwardly within the horizontal plane of the side legs 3 to define thereat pole ends 9, respectively, which are spaced closer than the other portions of the side legs 3. At the free end of the core 5, on the other hand, there is formed an upwardly projecting lip 10 which projects into the plane of the side legs 3 for horizontal alignment with said inwardly bent pole ends 9 of the side legs 3. Said coil bobbin 8 is held on the core 5 between the lip 10 and downward projecting tab 7, as shown in FIG. 2. It is noted at this time that the upper portion of the coil 6 is received within the plane of the side legs 3 and does not project upwardly beyond that plane.

The electromagnet block 1 thus constructed is mounted on the base plate 40 so that the plane of the side legs 3 is in parallel and spaced relation above the base plate 40 by a minimum distance for accommodating therebetween the contact assemblies 30. The lower ends of the tab 7 and the flanges of coil bobbin 8 are received in a recess 41 formed in the upper surface of base plate 40 and at the same time an anchor 11 on the underside of the free end of core 5 is snugly fitted in a corresponding aperture 42 in the base plate 40 for secure mounting of the electromagnet block 1.

The armature block 20 is dimensioned to have substantially the same height as the electromagnet block 1 or the height of the plane of the side legs 3 from the base plate 40 and to have a width less than the yoke 2. Included in the armature block 20 is a pair of pole plates 22 which are cooperative with said permanent magnet 21 to present a generally horizontally disposed U-shaped configuration with the pole plates 22 being the legs of the U. That is, the permanent magnet 21 is held between the ends of the pole plates 22 to magnetize the pole plates 22 to opposite polarity. A plastic molding 23 of electrically insulative material is integrally molded with the permanent magnet 21 and the pole plates 22 in such a manner as to surround the same except for the opposing inner pole faces and the upper halves of the outer pole faces of the individual pole plates 22, providing a one-piece construction of the armature block 20. The molding 23 is bulged at the portion on either side of the armature block 20 or the portion covering the lower half of the outer pole face of each pole plate 22 to form thereat a laterally projecting actuator ear or card 24, which actuates the adjacent contact assembly 30 to make or break the contacts thereof.

The armature block 20 thus formed is mounted at one longitudinal end portion of the base plate 40 with its upper surface flush or aligned with that of the yoke 2 so as not to add an extra height to the relay construction. The armature block 20 is magnetically coupled with said electromagnet block 1 in such a manner that the free end of each pole plate 22 projects into the corresponding space between each of said pole ends 9 of the side legs 3 and the lip 10 at the free end of the core 5, whereby it can reciprocate in a direction perpendicular to the lengthwise direction of the core 5 or the base plate 40 within a limited extent. Thus, the armature block 20 can be driven in response to the energization of the coil 6 to reciprocate transversely of the base plate 40 between two laterally spaced positions, at each position of which one of the pole plate 22 is attracted toward the lip 10 of the core 5 and simultaneously the other pole plate 22 is attracted to one of the pole ends 9 of the side legs 3, as shown in FIG. 2. At each of the above two operating position, there is established a closed path of the flux from the permanent magnet 21, whereby holding or latching the armature block 20 at the corresponding position after deenergization of the coil 6. That is, the flux from the permanent magnet 21 goes through the core 5 and returns through one of the side legs 3 to complete the magnetic circuit of the permanent magnet 21. In this sense, the polarized relay of the present embodiment is a latching relay of bistable type. Formed on the bottom of the molding 23 at the portions adjacent the respective actuator ears 4 are studs 25 which are received into laterally elongated slots 43 in the base plate 40 for stably guiding the armature block 20 in its reciprocating motion while preventing an unintended longitudinal movement thereof.

Each of said contact assemblies 30 is mounted on the lateral side of base plate 40 outwardly of the coil in such a manner as to be received in the space left between the adjacent side leg 3 of the yoke 2 and the base plate 40, as best shown in FIG. 4. Each contact assembly 30 comprises a movable spring 31 extending along the length of the base plate 40, a supporting post 32 anchored to the base plate 40 at the middle portion along the length thereof for supporting one end of the movable spring 31, movable contacts 33 carried on both side of the free end of the movable spring 31, a pair of terminal posts 34 mounted on the longitudinal end of the base plate 40 laterally outwardly of the armature block 20 and spaced laterally from one another to receive therebetween the free end of the movable spring 31, and fixed contacts 36 carried respectively on the opposed inner faces of the terminal posts 34 to be in engageable relation with the adjacent movable contacts 33, respectively. Thus, the relays of the present embodiment have a pair of transfer contact switching portions S located at the one longitudinal end on both sides of the armature block 20. In other words, a DPDT (double-pole double-throw) contact arrangement is employed in this embodiment with its contact switching portions S located at one longitudinal end of the base plate 40. The movable spring 31 carrying the movable contacts 33, terminal posts 34 carrying the fixed contacts 36 are electrically connected to corresponding terminal lugs 37 projecting on the underside of the base plate 40 for connection with external circuits to be controlled. Also, the base plate 40 is provided with a pair of coil terminal lugs 38 electrically connected to the coil 6 and projecting on the underside of the base plate 40. A plastic cover 13 is secured to the base plate 40 for enclosing the parts thereon.

Both of the movable springs 31 are spaced outwardly from the coil by a minimum distance for ensuring electric insulation therebetween and are normally biased inwardly so as to bring each of the movable contacts 33 into contact with the inwardly located fixed contacts 36 of each set of the fixed contacts in the absence of the armature block 20. At either of the two operating positions, the armature block 20 is in cooperation with the contact assemblies 30 in such a manner that one of the actuator ears 24 pushes the adjacent movable spring 31 outwardly to disengage the movable contact 33 from inner fixed contact 36 and engage it with the outer fixed contact 36, while the other actuator ear 24 applies no force to the adjacent movable spring 31 so as to allow it to be urged inwardly by its resiliency for engagement of the movable contact 33 with the inner fixed contact 36, as best shown in FIG. 2.

In operation, when the coil 6 is energized by a given polarity of a direct current voltage so that a particular pole (for example, north pole) appears at the lip 10 at the free end of the core 5 and the opposite pole (south pole) appears at the respective pole ends 9 of the side legs 3 of the yoke 2, the armature block 20 responds to be driven to move laterally into one of its two positions with its one pole plate (magnetized with south pole) 22 being attracted to the lip 10 (north pole) and the other pole plate (magnetized with north pole) 22 attracted to the one pole end (south pole) 9, whereby the actuator ears 24 on both sides of the armature block 20 are in operation to actuate the contact assemblies 30, as in the manner previously described, to cause the switching functions thereof. After deenergization of the coil 6, the armature block 20 is kept or latched in position by the magnetic flux extending from the permanent magnet 21 and passing through the part of the yoke 2 to complete the magnetic circuit, as previously described. When, on the other hand, the coil 6 is energized by a direct current voltage which is of opposite polarity to the above, the armature block 20 is driven to move laterally into the other position by the attracting and repelling forces developed between the opposed pole ends 9 of the yoke 2 and the pole plates 22 to thereby actuate the contact assemblies 30 for reversing the contacts, which condition is kept also by the magnetic circuit established between the permanent magnet 21 and the part of the yoke 2 even after the deenergization of the coil 6 and can be reversed only by applying again the voltage of opposite polarity across the coil 6. In this manner, the armature block 20 is driven to reciprocate for switching functions at each time of reversing the voltage to be applied to the coil 6.

In the present embodiment, the movable spring 31 of each contact assembly 30 extends along the adjacent side leg 3 of the yoke 2 to a point beyond the pole end 9 thereof so as to located at the one longitudinal end of the base plate 40 said contact switching portion S, which is positioned forwardly of the pole end 9 to be opened upwardly without being obstructed by the side leg 3. In other words, each side leg 3 does not extend over the contact switching portion S of the adjacent contact assembly 30 to allow the portions S to be directly accessible from the above for adjustment of contact gap or contact pressure after mounting the electromagnet block 1, armature block 20, and the contact assemblies 30. Such adjustment can be performed by bending the terminal posts to vary the dimensional relation between the contacts in each set of the fixed and movable contacts. In fact, due to possible variations in spring characteristics of the movable springs employed, such adjustment may be sometimes required for obtaining a desired load characteristic of the relay.

Also, in the present embodiment, the core or center leg 5 is dimensioned to have a shorter length than the side legs 3 so as to allow the armature block 20 to be located closer along the longitudinal axis of the base plate 40 to the fixed end of the core 5 as opposed to the case in which the core 5 is of the same length as the side legs 3, contributing to reducing the length of the relay and bringing the actuator ear 24 on either side of the armature block 20 into an optimum engaging position with the adjacent movable spring 31 for assuring an effective switching operation with a limited amount of lateral movement of the armature block 20.

Figure 5:
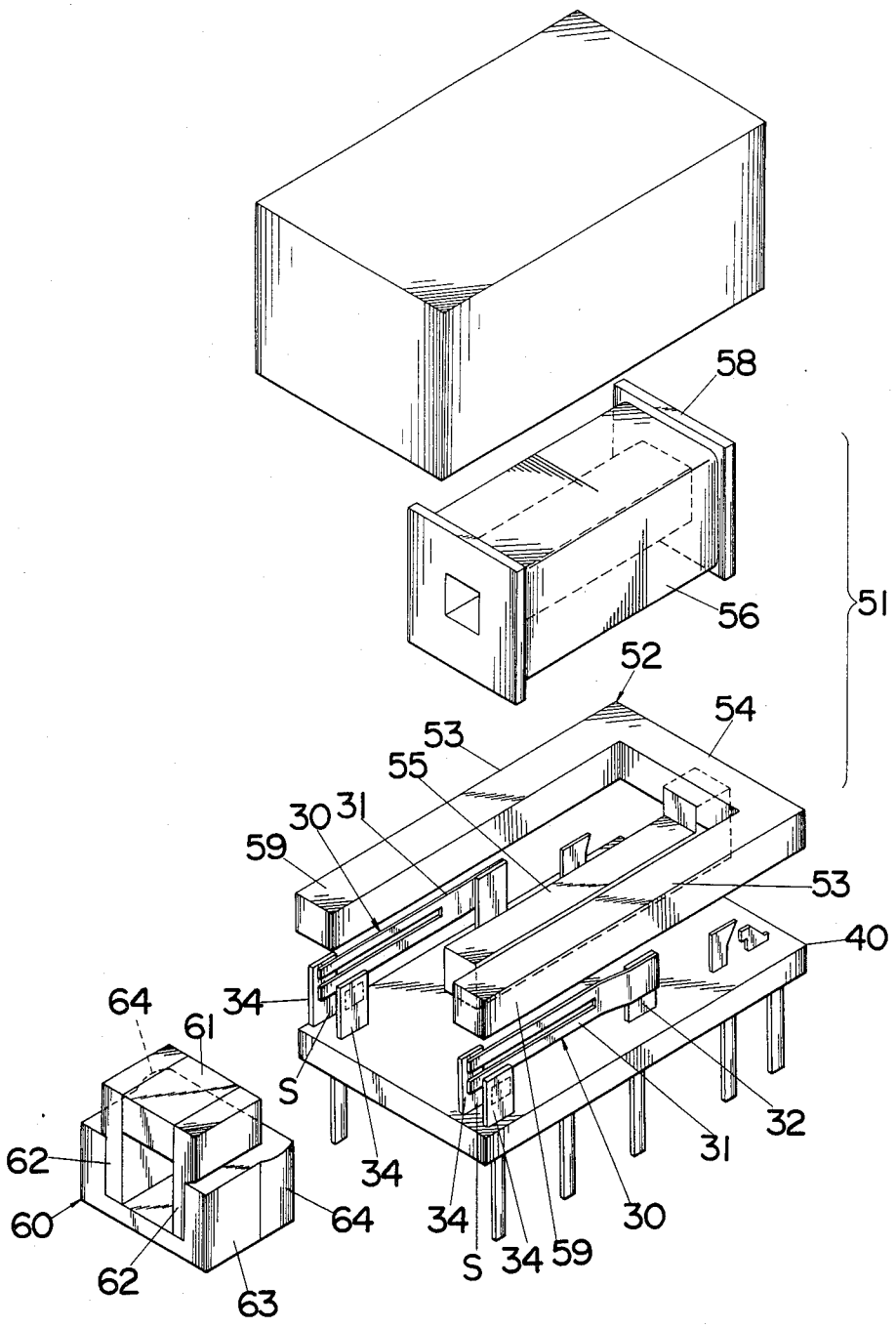
FIG. 5 is an exploded parts view, in perspective representation, of a polarized relay in accordance with a second embodiment of the present invention.

Referring to FIG. 5, there is disclosed a polarized electromagnetic relay in accordance with a second preferred embodiment of the present invention which is similar in construction to the first embodiment except for the exact configurations of an electromagnet block 51 and an armature block 60. The other parts identical to the first embodiment are designated by like numerals as in the first embodiment. A generally E-shaped yoke 52 in the electromagnet block 51 is formed by combining an L-shaped member and a U-shaped member in such a manner as to define a pair of opposed side legs 53 by the legs of the U as well as define a center leg or core 55 by the elongated leg of the L. That is, the short leg of the L is secured by welding or the like integral connecting method to a web member 54 of the U-shaped member so that the center leg or core 55 is displaced downwardly from the plane of the side legs 53, just in the same manner as in the first embodiment. The core 55 likewise extends through a coil bobbin 58 carrying therearound an excitation coil 56 for supporting the same. In this embodiment, each of the side legs 53 extends over the contact switching portion S of each contact assembly 30 and the core 55 extends in short of the pole ends of the side legs 53. In the armature block 60, a permanent magnet 61 is cooperative with a pair of opposed pole plates 62 to define a generally vertically disposed inverted U-shape configuration with the pole plates 62 forming the legs of the U. A like plastic molding 63 integrally surrounds the pole plates 62 to hold the permanent magnet 61 therebetween in such a manner that the gap between the pole plates 62 are opened at both the front and rear ends for permitting the insertion of the free end of the core 55 therethrough. The molding 63 is formed on either side thereof with a laterally bulged actuator ear 64 which is engageable with the adjacent movable spring 31 of the contact assembly 30. The armature block 60 is cooperative with the electromagnet block 51 to extend the free end of the core 55 through the gap between the pole plates 62 so that each of the pole plates 62 is inserted between the free end of the core 55 and each of the pole ends 59 at the free ends of the side legs 53, providing a magnetic coupling between the blocks. At this coupling assembly, the permanent magnet 61 is located above the free end of the core 55 but is received within the plane of the side legs 53, adding no extra height to the relay construction.

Figure 6:
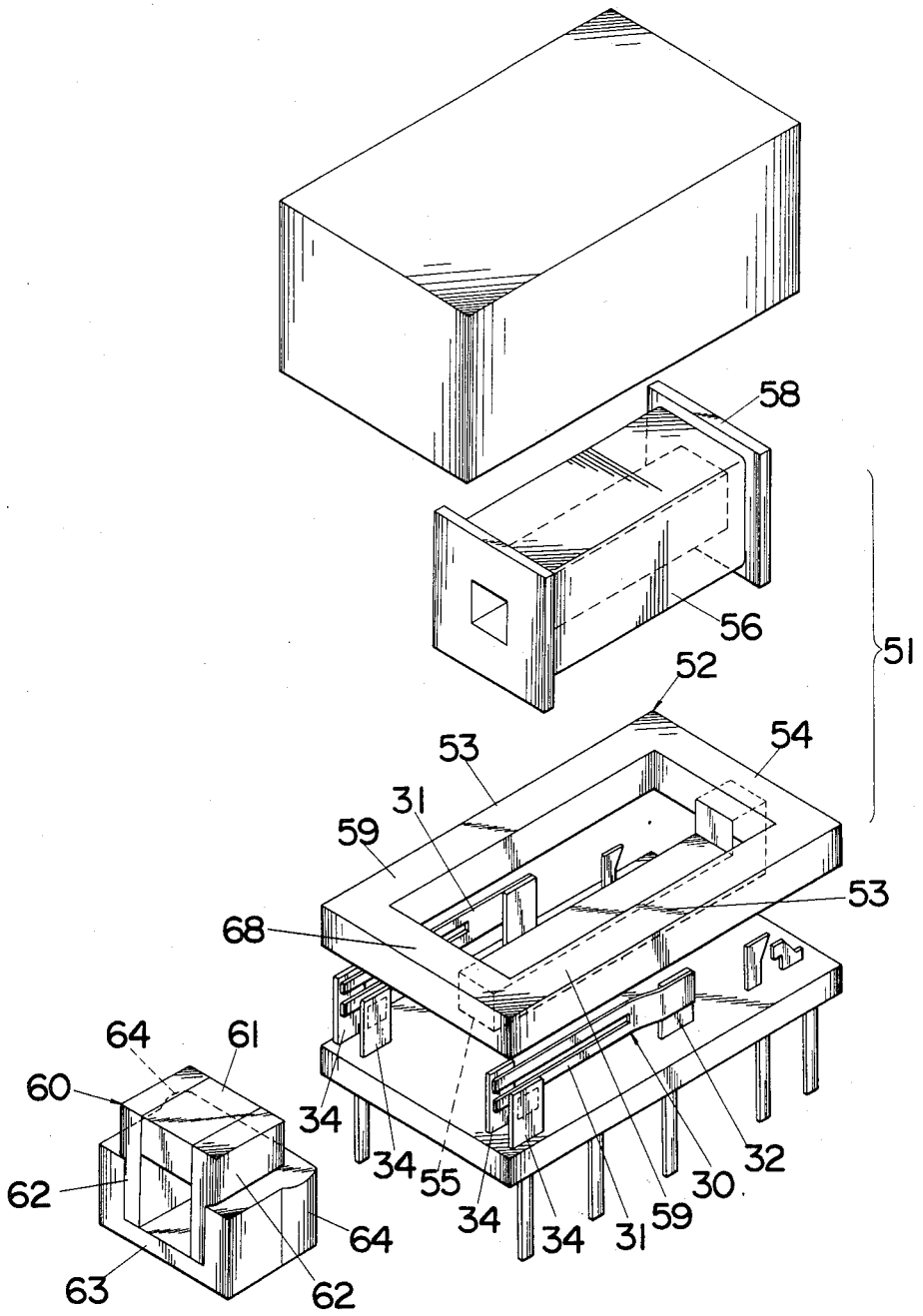
FIG. 6 is an exploded parts view, in perspective representation, of a modification of FIG. 5.
Figure 7:
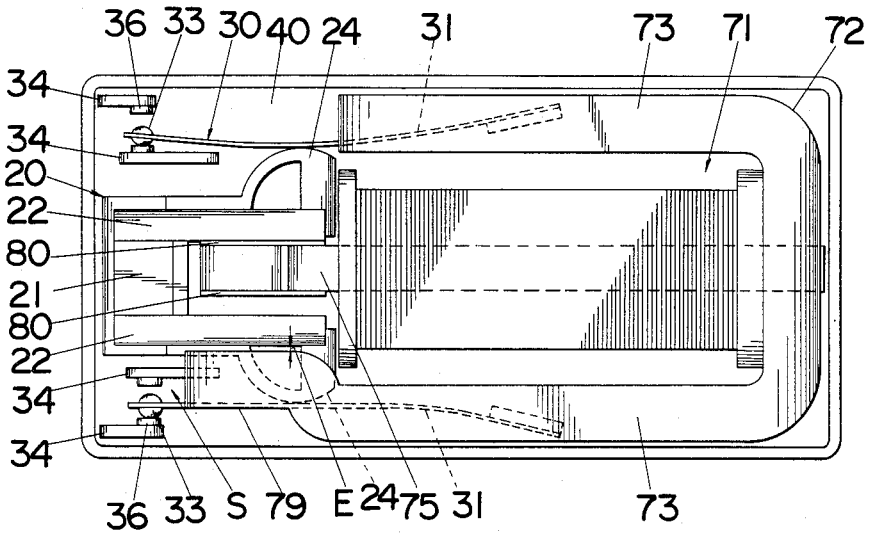
FIG. 7 is a top view of a polarized relay of monostable type in accordance with a third embodiment of the present invention.
Figure 8:
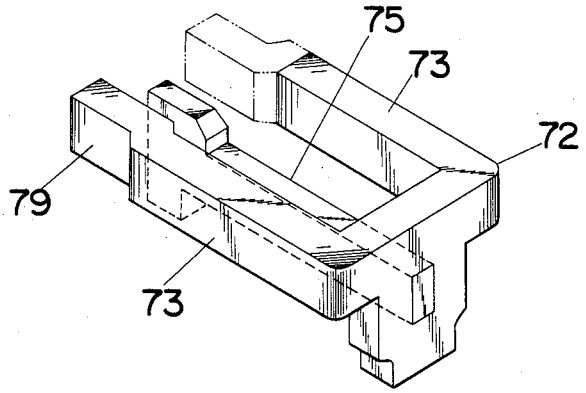
FIG. 8 is a perspective view of a yoke employed in the above relay.
Figure 9:
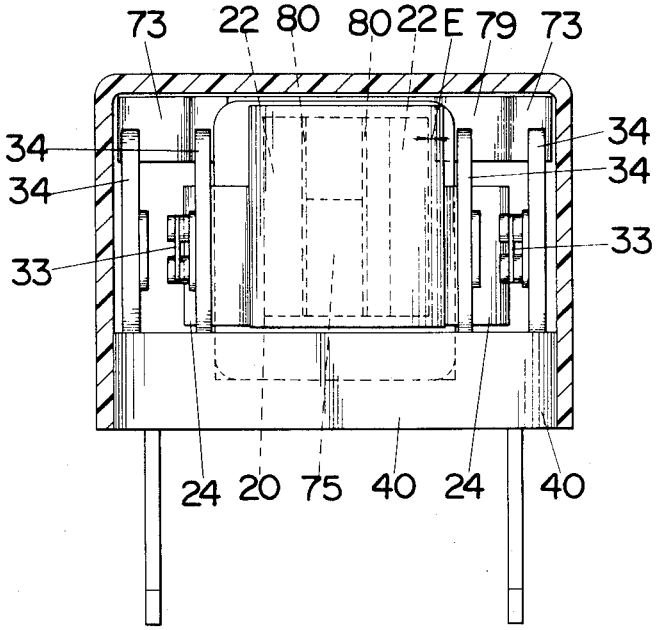
FIG. 9 is a cross sectional view of the above relay.
Figure 10:
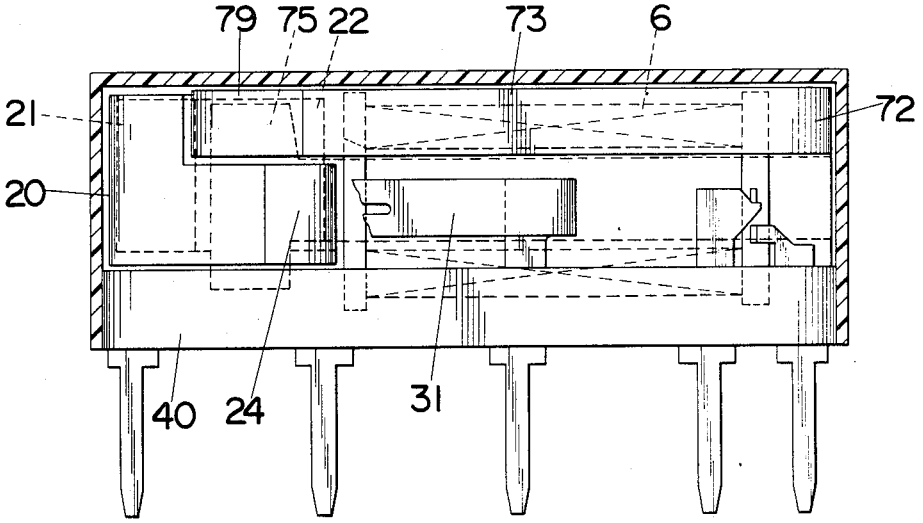
FIG. 10 is a front view, in rather schematic representation, of the above relay.

FIG. 6 illustrates a modification of the above second embodiment which is identical thereto except that a connecting bar 68 bridges between the pole ends of the side legs 53 for the purpose of reinforcing the yoke 52. Thus, the pole ends 59 of the yoke 52 are kept in fixed positions free from being misaligned with the free end of the core 55 during the assembly and of course during the relay operation, ensuring an consistent magnetic relation between the electromagnet block 51 and the armature block 60 to thereby provide a stable and reliable operation of the relay. In this modification, the connecting bar 68 is formed integrally with the yoke 52. However, a separate connecting bar may be utilized for rigid connection between the pole ends of the side legs such as by welding or the like linking method. Further, the connecting bar 68 may be made of material other than magnetic material, but the connecting bar 68 when made of magnetic material can serve to provide a magnetic shield preventing magnetic leakage from the yoke.

A polarized relay in accordance with a third embodiment of the present invention is illustrated in FIGS. 7 to 10. The relay of this embodiment is of single-stable (mono-stable) type as opposed to the previous embodiments and modification and is similar in construction to the first embodiment except for the configuration of a yoke 72 and the introduction of residual plates 80 on both sides of the free end of the core 75. Like numerals are employed for designating like parts as in the first embodiment. The yoke 72 is configured to have an opposed side legs 73 one of which is longer than the other so that only the longer side leg 73 defines at its free end a pole end 79 in magnetically connectable relation with the adjacent pole plate 22 of the armature block 20. The other configuration of the yoke 72 is identical to that of the first embodiment. That is to say, the yoke 72 of the present embodiment is obtained by removing the free end portion of one side leg of the yoke employed in the first embodiment, as indicated by phantom lines in FIG. 8. With this construction of the yoke 72 having only one pole end 79 at the free end of the longer side leg 73, the magnetic flux from the permanent magnet 21 can complete the magnetic circuit with the yoke 72 only when the armature block 20 assumes one of its positions, or the position shown in FIG. 7 in which one pole plate 22 is attracted through the residual plate 80 against the free end of the core 75 while the other pole plate 22 is attracted through a residual gap E toward the pole end 79 of the longer leg 73. Accordingly, the armature block 20 is latched in this position when the coil 6 is deenergized and is only driven to move in the other position when the coil is energized by a particular polarity of direct current voltage. That is, only when the coil 6 is energized in a direction of developing at the free end of the core 75 a pole which is identical to that of the pole plate 22 being attracted to the core 75 in the deenergized condition, the armature block 20 is moved to the other position for actuating the contact assemblies 30. With this result, under no circumstances can the relay be moved into the other position when the coil is energized by a voltage which is of opposite polarity to the above. Consequently, the relay of the present embodiment will be responsive to only a give polarity of direct current voltage and can not function by the opposite or wrong polarity of direct current voltage.

Said residual plates 80 and/or the gap E are introduced for reducing the undesirable effect due to the residual magnetism in the core 75 for improving the armature operation. Although the present embodiment adopts the arrangement of attaching the residual plates 80 on both sides of the core 75, it is equally possible to attach the residual plate to either side of the core 75.

In the above embodiment, the relay is made to be of monostable type by modifying the first embodiment in such a manner as to remove one of the free ends of the yoke, other modifications may be available for providing a monostable type relay from the first or second embodiments when designing to give a larger resistance value in the magnetic circuit of flux from the permanent magnet at one of the two positions of the armature block than at the other positions, at latter position of which the armature block is stable. Such modifications are therefore aimed to differentiate the cross section of the part forming the path of magnetic circuit at the one position of the armature block from that of the part forming that path at the other position. For example, it may be effective to vary the face area, thickness of the pole end of one side leg with respect to that of the other side leg, or to vary the face area on one side of the free end of the core with respect to that on the other side thereof. Further, said residual plates can be utilized for modifying the relay of the first or second embodiment into a monostable relay by varying the thickness between the residual plates on both sides of the core. It may be also effective for the above purpose to process the parts forming the path of the magnetic circuit to have increased or decreased magnetic resistance, such as by providing a projection, recess or the like seriously affecting the above resistance value for differentiating the magnetic resistance of the magnetic circuit from the permanent magnet at the one position of the armature block from that at the other position thereof.

What is claimed is:

1. In a polarized relay comprising, in combination, an electromagnet block, an armature block with a permanent magnet responding to energization of the electromagnet block to reciprocate between two operating positions, at least one contact assembly which is actuated by the reciprocating armature for contact switching, and a base plate for mounting thereon said electromagnet block, armature block and the contact assembly, said electromagnet block including a generally E-shaped yoke with a pair of opposed side legs and a center leg projecting from a web member thereof, said center leg defining a core around which an excitation coil is wound, the improvement comprising the core being displaced from the plane of the opposed side legs of the yoke toward the base plate and that said contact assembly is disposed on the side of the core so as to be received in the space left between the side leg of the yoke and the base.

2. A polarized relay as set forth in claim 1, wherein said armature block and the coil wound around the core are received entirely within the confines of the space defined between the planes of the opposed side legs and the base.

3. A polarized relay as set forth in claim 1, wherein said contact assembly has its switching contact portion located on one end portion of the base and wherein the side leg on the same side of the core as the contact assembly extends longitudinally of the base and terminates at a point longitudinally inwardly of said switching contact portion in such a way as not to extend over said switching contact portion, whereby the switching contact portion of the contact assembly is opened upwardly of yoke.

4. A polarized relay as set forth in claim 1, wherein said armature block includes a pair of pole plates between the ends of which said permanent magnet is held to magnetize the pole plates to opposite polarity, said armature block being positioned to cooperate with said electromagnet block such that the free end of the core extends between the opposed inner pole faces of the pole plates and that at least one of the pole plates has its outer face away from the core and is in magnetically connectable relation with the pole end at the free end of the adjacent side leg of the yoke.

5. A polarized relay as set forth in claim 1, wherein said yoke of the electromagnet block further includes a connecting bar rigidly bridging the pole ends of the side legs for reinforcement of the yoke.

6. A polarized relay as set forth in claim 1, wherein said armature block includes a pair of pole plates between the ends of which said permanent magnet is held to magnetize the pole plates to opposite polarity, said armature block being cooperative with said electromagnet block such that the free end of the core extends between the opposed inner pole faces of the pole plates, and one of said side legs extending longer than the other side leg so that only the longer side leg define at its free end a pole end which is in magnetically connectable relation with one of the pole plates of the armature block whereby the armature is rendered stable only at one of its two positions where flux from the permanent magnet completes the path of magnetic circuit as passing through the core and the lower side leg of the yoke.

* * * * *